United States Patent [19]

Ehring et al.

[11] Patent Number: 4,561,121

[45] Date of Patent: Dec. 31, 1985

[54] MULTILAYERED PROTECTIVE TROUSER

[75] Inventors: Carolyn C. Ehring, West Caldwell; Edward W. Baumgartner, Edison, both of N.J.

[73] Assignee: Cairns & Brother Inc., Clifton, N.J.

[21] Appl. No.: 651,803

[22] Filed: Sep. 18, 1984

[51] Int. Cl.[4] ..... A41D 1/06

[52] U.S. Cl. ..... 2/2; 2/227; 2/234

[58] Field of Search ..... 2/227, 234, 235, 236, 2/85, 2

[56] References Cited

U.S. PATENT DOCUMENTS

| | | | |
|---|---|---|---|
| 2,709,667 | 5/1955 | Grubb et al. | 2/2 X |
| 2,761,515 | 9/1956 | Feild et al. | 2/2 X |
| 3,111,680 | 11/1963 | Horowitz et al. | 2/227 |
| 3,352,364 | 11/1967 | De Coste | 2/2 X |
| 4,259,750 | 4/1981 | Barna | 2/234 |

*Primary Examiner*—Louis K. Rimrodt

*Attorney, Agent, or Firm*—Louis E. Marn

[57] ABSTRACT

There is disclosed a multilayered protective trouser comprised of: a trouser inner liner including a fly opening and a storm flap folded upon itself to form two layers having fastening means secured thereto; and a trouser outer shell including a fly opening and an outer shell tab having fastening means secured thereto. The storm flap extends across both of the fly openings, while the outer shell tab is removably positioned between the two layers of the storm flap to provide removable attachments between the storm flap and the outer shell tab.

9 Claims, 7 Drawing Figures

MULTILAYERED PROTECTIVE TROUSER

The invention relates to a multilayered protective trouser, and more particularly to a multilayered protective trouser for a firefighter comprising a trouser inner liner and a trouser outer shell, that may be expeditiously assembled or disassembled.

BACKGROUND OF THE INVENTION

Protective outer garments for firefighters usually include heavy protective turnout coats, and some form of upper leg protection to insulate them from the hazards of structural fires. Firefighters are exposed to intense heat, smoke and moisture, and such environmental conditions are compounded by the general character of the ambient weather conditions, e.g. extreme cold or extreme heat. Protective outer garments for firefighters are primarily designed to shed water and to thermally insulate the firefighters from extraordinary temperatures.

The protective garments worn by firefighters are generally comprised of an outer shell of extremely tough fabric for protection, a moisture barrier which serves primarily to shed water, and an inner insulating liner. Often times, in hot weather, the firefighters may remove their inner insulating liners for comfort when not involved in active firefighting, and then don their outer protective shells absent the inner insulating liners when called to duty. Such firefighters the fire environment and because of the design of the outer protective shell, there is no visual means by which supervisory officers may easily discern whether or not inner insulating liners are being worn. Additionally, because of the environment in which the firefighters must perform, and the physical activity which they must perform, enormous amounts of moisture are generated by their bodies that is absorbed in the inner insulating liners. Consequently, if there is no opportunity to change the inner insulating liners, or to launder and dry same, and the firefighters are required to respond to subsequent fires with only a short duration between a prior firefighting activity, they find themselves wearing uncomfortably cold and moisture saturated inner insulating liners.

In an effort to provide improved protection for firefighters, multilayered protective coats of the type, for example, described in of common assignee copending U.S. patent application Ser. No. 6/470,462, filed Feb. 28, 1983 now U.S. Pat. No. 4,507,806 have been developed to provide more effective protective envelopes about the wearer thereof. Generally, a coat of such type includes: (i) a damage-resistant outer shell having an openable body portion with sleeves appended thereto, and a closure means such as a zipper or other fastening means for securing the openable body portion; (ii) an inner thermal liner comprised of a body portion having appended thereto sleeves and closure means which is substantially coincidental with the closure means of the outer shell; and (ii) a means for removably securing the outer shell to the inner liner. The inner liner of such a coat includes an interior thermal layer which is comprised of material suitable to provide thermal insulation, and a barrier layer comprised of a material suitable to provide a moisture barrier, the barrier layer being fixedly secured to the exterior surface of the thermal layer. Characterizing a coat of the type described in the aforesaid application is the design advantage of being able to readily separate the inner liner from its associated outer shell, for permitting the substitution of a clean and dry inner liner. Additionally, such a coat includes a readily observable feature for discerning whether or not the inner liner is being worn.

OBJECTS OF THE INVENTION

An object of the present invention is to provide a novel multilayered protective trouser comprising a trouser inner liner and a trouser outer shell, the features of which enable the expeditious complete assembly and disassembly of the multilayered protective trouser.

Another object of the present invention is to provide a novel multilayered protective trouser comprising a trouser inner liner and trouser outer shell so interrelated as to provide a readily observable indication of the absence of a complete assemblage of the multilayered protective trouser.

Still another object of the present invention is to provide a novel multilayered protective trouser that, in view of its geometric figuration and its susceptibility to expeditious complete assembly and disassembly, may be employed in conjunction with a multilayered protective coat of the type described in the aforesaid copending United States Application to form in combination a multilayered protective body garment.

SUMMARY OF THE INVENTION

These and other objects of the present invention are achieved by a multilayered protective trouser comprised of a trouser inner liner including a fly opening and a storm flap folded upon itself to form two layers having fastening means secured thereto; and a trouser outer shell including a fly opening and an outer shell tab having fastenng means secured thereto. The storm flap extends across both of the fly openings, while the outer shell tab is removably positioned between the two layers of the storm flap to provide removable attachments between the storm flap and the outer shell tab, as more fully disclosed herein.

BRIEF DESCRIPTION OF THE DRAWINGS

A better understanding of the present invention as well as the objects and advantages thereof will become apparent upon consideration of the following detailed disclosure thereof, especially when taken with the accompanying drawings; wherein:

Referring to FIGS. 1–4 and 7, there are illustrated a trouser inner liner 20 comprised of a layered combination of thermal insulative material and moisture barrier material, and a trouser outer shell 30 of damage-resistant material suitable for providing fire protection. The trouser inner liner 20 and the trouser outer shell 30 are sized and configured to permit the wearing by a firefighter of the former within the latter to constitute a multilayered protective trouser 10, illustrated in FIGS. 1 and 7. The trouser inner liner 20 includes a pair of inner liner legs 21 and 21'; an inner liner body section 22; and a storm flap 23, and an inner liner waist band 24 comprised of material similar to that of the trouser outer shell 30. The trouser outer shell 30 includes a pair of outer shell legs 31 and 31', an outer shell body section 32, and an outer shell tab 33, and outer shell waist band 34 comprised of contrasting color outer shell material.

Figure 1:
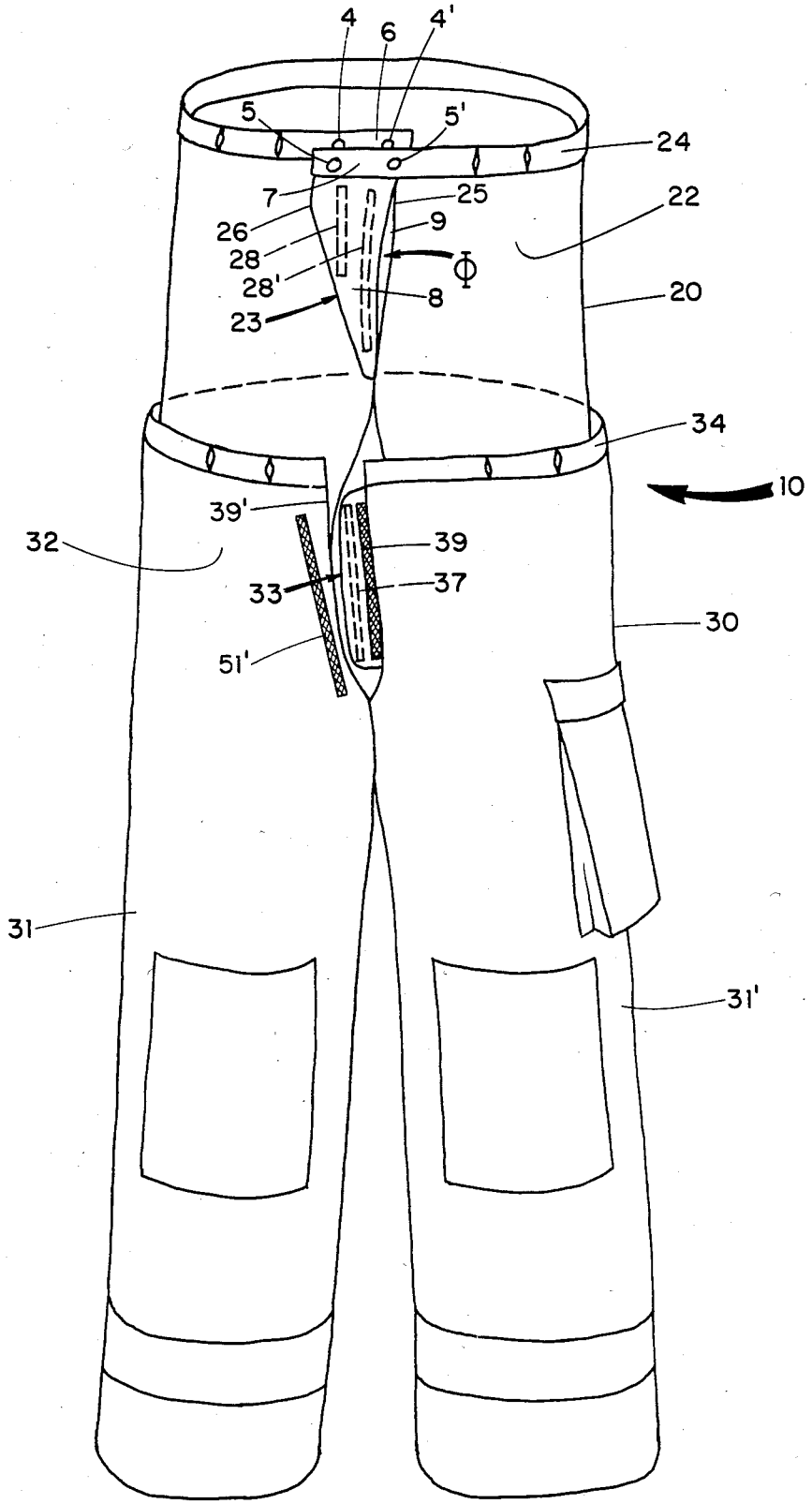
FIG. 1 is a perspective view of a partially assembled multilayered protective trouser in accordance with the present invention.
Figure 2:
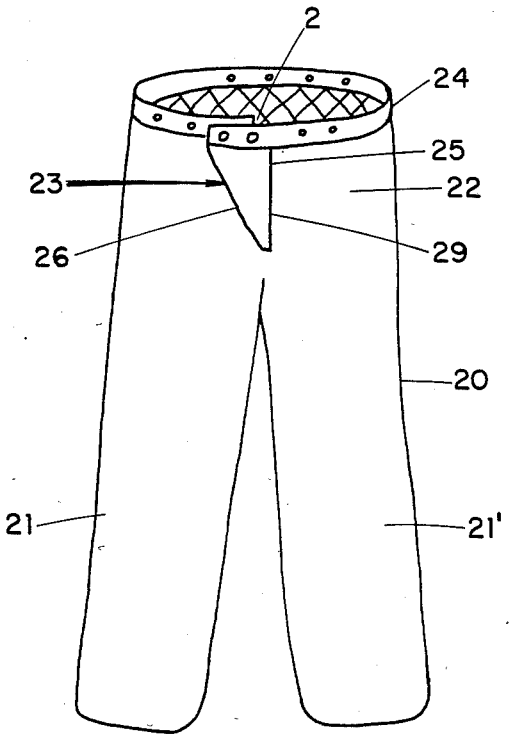
FIG. 2 is a perspective vew of a trouser inner liner of the multilayered protective trouser depicted in FIG. 1.
Figure 3:
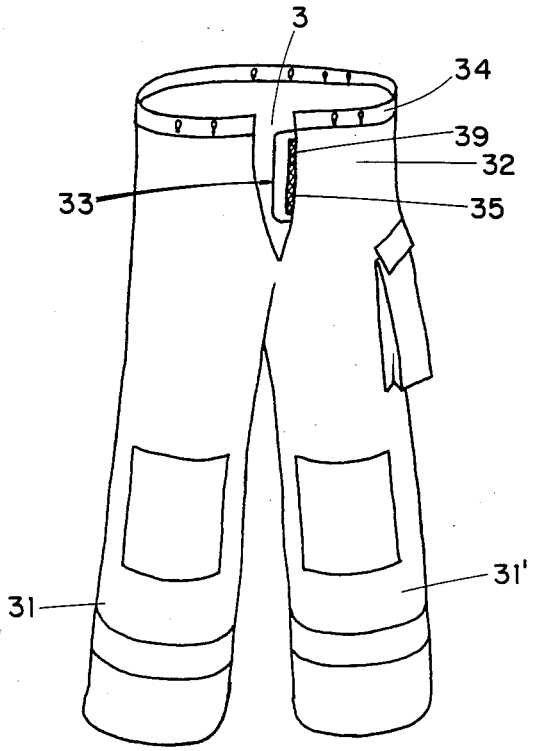
FIG. 3 is a perspective view of a trouser outer shell of the multilayered protective trouser depicted in FIG. 1.

The storm flap 23 of the trouser inner liner 20 is comprised of a material similar to that of the outer shell 30, but has an interior lining of moisture barrier material similar to that of the trouser inner liner 20. The storm flap 23 has a major side 25 fixedly attached to a peripheral side 29 of a fly opening 2 within the inner liner body section 22, and is folded upon itself along an edge 26, to form front and rear layers 8 and 9, the opposite interior surfaces of which define a storm flap pocket Φ. The upper peripheral sides of the front and rear layers 8 and 9 of the storm flap 23, are fixedly attached to each other under the inner liner waist band 24. Within the pocket Φ of the storm flap 23, the storm flap 23 has secured thereto, on the surface of the rear layer 9 defining a back face of the pocket Φ, a VELCRO® fastening strip 28, and on the surface of the front layer 8 defining a front face of the pocket Φ, a VELCRO® fastening strip 28', each which extends in a generally vertical direction. Additionally, the storm flap 23 has secured thereto, on an interior surface 27 of the rear layer 9 removed from the pocket Φ, a VELCRO® fastening strip 51, which is positioned in the proximity of, and extends parallel to, the fold edge 26 of the storm flap 23. Though the embodiment disclosed herein references the use of various VELCRO® fastening strips, other suitable fastening means may be used by one skilled in the art without departing from the scope of the present invention.

Figure 4:
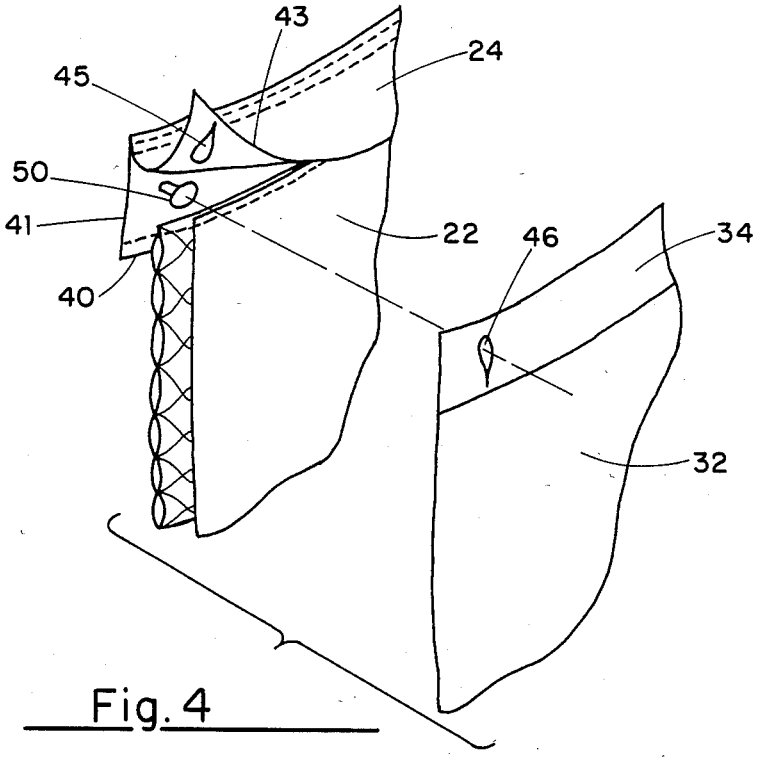
FIG. 4 is a perspective exploded cut-away view of a waist band arrangement for removably securing the trouser inner liner to the trouser outer shell in accordance with the present invention.
Figure 5:
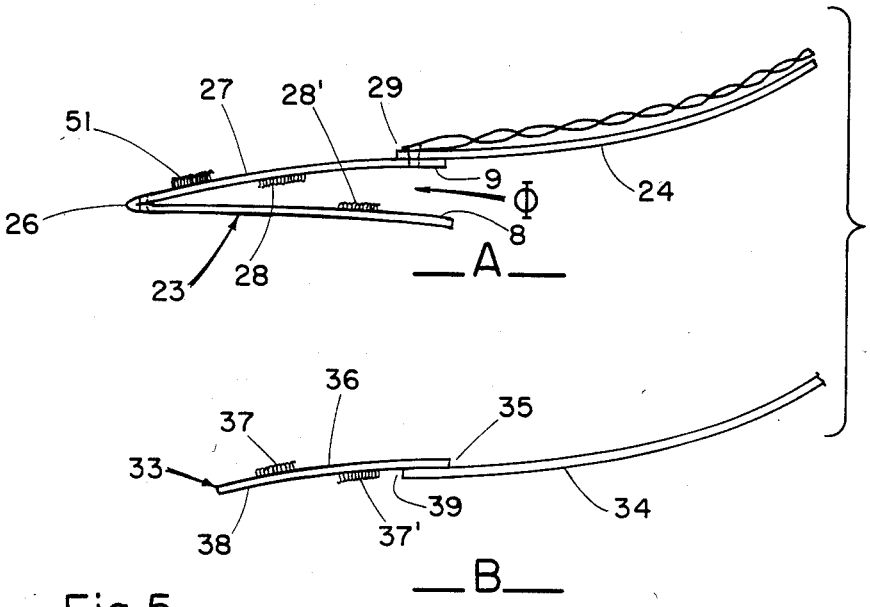
FIG. 5 depicts (A) a top plan view of a storm flap incorporated in the trouser inner liner of FIG. 2, and (B) a top plan view of an outer shell flap incorporated in the trouser outer shell of FIG. 3.

As illustrated in detail in FIG. 4, the inner liner waist band 24 is folded down upon itself forming a waist band strip 41 that is circumferentially secured to an upper peripheral surface 40 of the inner liner body section 22, and a waist band flap 43 that may be raised for the placement thereunder of the outer shell waist band 34. Fixedly attached about the circumference of the waist band strip 41 are a plurality of spacially separated fastening buttons 50 for attachment of suspenders (only one shown). Located within the outer shell waist band 34, and within the waist band flap 43 are, respectively, a plurality of button holes 46 and 45, each of which is so aligned as to permit attachment of the trouser inner liner 20 to the trouser outer shell 30, by the placement of the outer shell waist band 34 under the waist band flap 43, and the passage of the fastening buttons 50 through the associated alinged button holes 46 and 45. Though the embodiment disclosed herein references the use of fastening buttons and associated button holes, other suitable detachable fastening means may be used by one skilled in the art for the attachment of the inner liner waist band 24 and the outer shell waist band 34 without departing from the scope of the present invention.

Figure 7:
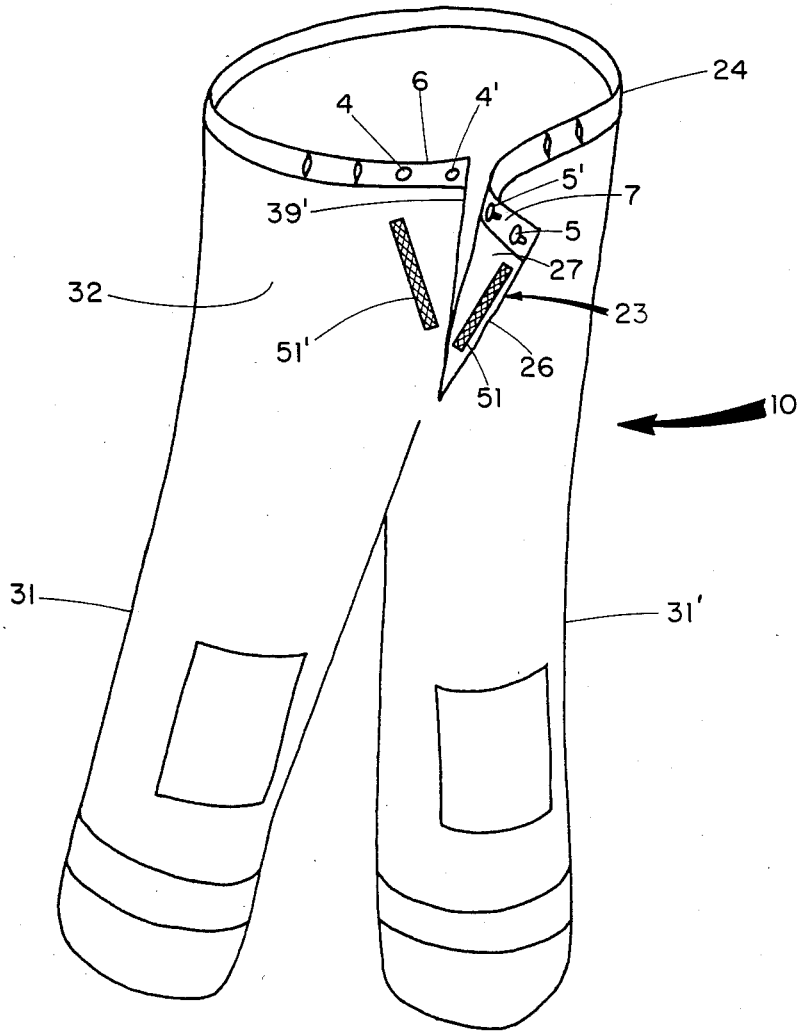
FIG. 7 is a perspective view of the multilayered protective trouser depicted in FIG. 1, wherein the trouser inner liner depicted in FIG. 2 and the trouser outer shell depicted in FIG. 3 have been assembled one within the other.

As illustrated in FIGS. 1 and 7, the inner liner waist band 24 is further provided with a pair of snap fastening means 4 and 4', and a pair of snap fastening means 5 and 5', positioned, respectively, in a circumferential end portion 6 and in a circumferential end portion 7 of the inner liner waist band 24 for securing the closure of the waist band 24 about a firefighter's waist. When the multilayered protective trouser 10 is being worn by the firefighter, the outer shell waist band 34 of the trouser outer shell 30 is positioned under the waist band flap 43 of the inner liner waist band 24 of the trouser inner liner 20, thus presenting the waist band 24 as a portion of the exterior surface of the assembled multilayered protective trouser 10. Accordingly, an external observance of the inner liner waist band 24 is a visual determination of the presence of the trouser inner liner 20 within the trouser outer liner 30. Additionally, the outer shell waist band 34 is of a bright color that contrasts with the color of the outer shell body section 32 of the trouser outer shell 30 for providing a readily observable indication of the absence of a complete assemblage of the multilayered protective trouser 10. More particularly, a bright contrasting color appears if the inner liner waist band 24 does not cover the outer shell waist band 34. An absence of the inner waist band 24 indicates the absence of the trouser inner liner 20 of which the former is an integral part.

The outer shell tab 33 of the trouser outer shell 30 is preferably comprised of damage-resistant material suitable for providing fire protection, and has a generally rectangular configuration. The outer shell tab 33 has a major side 35 fixedly attached to a peripheral side 39 of a fly opening 3 within the outer shell body section 32, and overlaps the fly opening 3. The width of the outer shell tab 33 is somewhat less than the width of the front and rear layers 8 and 9 of the storm flap 23 of the trouser inner liner 20. The outer shell tab 33 has secured thereto, on an inner surface 36 thereof, a VELCRO® fastening strip 37, and on outer surface 38 thereof, a VELCRO® fastening strip 37'. The VELCRO® fastening strips 37 and 37' each extend in a generally vertical direction and are spacially separated from each other by about the same spacial separation as that provided between the VELCROR® fastening strips 28 and 28'.

The outer shell body section 32 of the trouser outer shell 30, has secured thereto, on an outer surface thereof, a VELCRO® fastening strip 51' that extends in a generally diagonal direction parallel to the fold edge 26 of the storm flap 23. More particularly, the VELCRO® fastening strip 51' is located in the vicinity of a peripheral side 39' of the fly opening 3 so as to be positioned opposite to, and in longitudinal alignment with, the VELCRO® fastening strip 51 when the storm flap 23 of the trouser inner liner 20 is extended through the fly opening 3, and completely across and beyond the fly opening 2.

Figure 6:
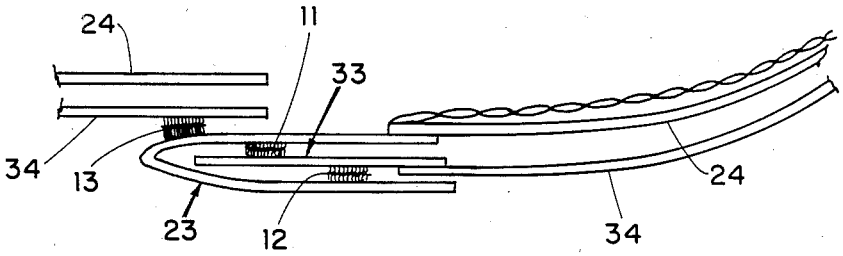
FIG. 6 is a top plan view of the assembled storm flap and outer shell flap illustrated in FIG. 5.

A description of the manner in which a firefighter may readily assemble the multilayered protective trouser 10 of the present invention will assist in the understanding of the purpose and intercooperation of the various features of the protective trouser 10. First, the trouser liner 20 is placed within the trouser outer shell 30, the outer shell waist band 34 is positioned under the waist band flap 43 of the trouser inner liner 20, and the suspender fastening buttons 50 are passed through the associated button holes 46 of the outer shell waist band 34, and through the associated button holes 45 in the waist band flap 43. Second, the multilayered protective trouser 10 so constituted, is stepped into, the storm flap 23 of the trouser inner liner 20 is extended from within the outer shell body section 32 through the fly opening 3, to the exterior of the body section 32, while being extended completely across and beyond the fly opening 2. Concurrently, the circumferential end portions 6 and 7 of the inner liner waist band 24 are drawn adjacent to each other, and the snap fastening means 4 and 4' are attached to the snap fastening means 5 and 5'. In this position of the storm flap 23, the VELCRO® fastening strip 51 and the VELCRO® fastening strip 51' are positoned opposite to each other and are pressed into engagement to form an elongated closure attachment 13 (FIG. 6). Third, the outer shell tab 33 is positioned within the pocket Φ of the storm flap 23, adjacent the rear layer 9 of the storm flap 23 so that the VELCRO® fastening strip 28' engages the VELCRO® fastening strip 37 to form an elongated closure attachment 11; and then the front layer 8 of the storm flap 23 is pressed against the outer surface 38 of the outer shell tab 33 so that the VELCRO® fastening strips 28 and 37' engage each other to form an elongated closure attachment 12. The elongated closure attachments 11, 12 and 13 permit the storm flap 23 to provide an essentially complete, readily reopenable, closure of both the fly opening 3 of the trouser outer shell 30, and the fly opening 2 of the trouser inner liner 20, thus providing complete fire protection and thermal insulation from the waist down of a firefighter's body positioned within the completely assembled, multilayered protective trouser 10. As the storm flap 23 of the trouser inner liner 20 is an essential component in forming the elongated closure attachments 11, 12 and 13, and thus is an essential element in the closure of the fly opening 3 of the trouser outer shell 30, the trouser outer shell 30 cannot be worn without the trouser inner liner 20. Thus, there is here provided an inherent design restriction to employing a trouser outer shell without a trouser inner liner for thermal insulation. Further, the outer shell tab 33 is of a bright color that contrasts with the color of the outer shell body section 32 of the trouser outer shell 30 for providing a readily observable indication of the absence of a complete assemblage of the multilayered protective trouser 10. More particularly, a bright contrasting color appears if the front and rear layers 8 and 9 of the storm flap 23 do not have positioned therebetween the outer shell tab 33. The absence of the storm flap 23 indicates the absence of the trouser inner liner 20 of which the former is an integral part.

While the invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed:

1. A multilayered protective trouser comprising:

a trouser inner liner comprising: an inner liner body section having a first fly opening; a storm flap having one side thereof fixedly attached to said inner liner body section, said storm flap being folded upon itself to form first and second layers; a first fastening means secured to a first surface of said first layer; and a second fastening means secured to a first surface of said second layer, said first surfaces of said first and second layers of said storm flap facing each other; and a trouser outer shell positioned about said trouser inner liner, said trouser outer shell including: an outer shell body section having a second fly opening; an outer shell tab having one side thereof fixedly attached to said outer shell body section; said outer shell tab being removably positioned between said first and second layers of said storm flap; and third and fourth fastening means secured, respectively, to first and second surfaces of said outer shell tab; wherein said storm flap extends through said second fly opening to the exterior of said outer shell body section, and completely across and beyond said first fly opening, said first fastening means engages said third fastening means, and said second fastening means engages said fourth fastening means to form, respectively, first and second removable attachments between said outer shell tab of such trouser outer shell and said storm flap of said trouser inner liner.

2. A multilayered protective trouser in accordance with claim 1 wherein said trouser inner liner includes a fifth fastening means secured to a second surface of said first layer of said storm flap; and said trouser outer shell includes a sixth fastening means secured to an exterior surface of said outer shell body on a side of said second fly opening removed from said outer shell tab, said fifth fastening means engaging said sixth fastening means to form a third removable attachment; said first, second and third removable attachments providing substantially complete closure of both said first fly opening and said second fly opening.

3. A multilayered protective trouser in accordance with claim 2 wherein said first and second fastening means are comprised of first and second fastening strips spacially separated from each other across adjacent surfaces of said first and second layers of said storm flap; said third and fourth fastening means are comprised of third and fourth fastening strips spacially separated from each other across said outer shell tab; said fifth fastening means is comprised of a fifth fastening strip positioned in the proximity of, and extending parallel to, a fold between said first and second layers of said storm flap; and said sixth fastening means is comprised of a sixth fastening strip extending directly opposite to said fifth fastening strip, in a direction parallel to said fold between said first and second layers of said storm flap.

4. A multilayered protective trouser in accordance with claim 1 wherein said trouser inner liner includes an inner liner waist band circumferentially secured to an upper peripheral surface of said inner liner body section, said waist band including seventh and eighth fastening means positioned, respectively, in first and second end portions of said waist band for securing the closure of said waist band, said first end portion of said waist band engaging a portion of said storm flap to secure same across said first fly opening of said inner liner body section.

5. A multilayered protective trouser in accordance with claim 4 wherein said first end portion of said inner liner waist band is fixedly attached to upper peripheral portions of said first and second layers of said storm flap, said first and second layers having opposite interior surfaces that define a pocket into which said outer shell tab is removably positioned.

6. A multilayered protective trouser in accordance with claim 4 wherein said inner liner waist band includes a ninth fastening means circumferentially positioned about said waist band and removably attached to an upper peripheral portion of said outer shell body section for securing said trouser inner liner to said trouser outer shell.

7. A multilayered protective trouser in accordance with claim 6 wherein said inner liner waist band is folded down upon itself to form a waist band strip circumferentially secured to said inner liner body section, and a waist band flap under which said peripheral portion of said outer shell body section is positioned.

8. A multilayered protective trouser in accordance with claim 7 wherein said trouser outer shell includes an outer shell waist band circumferentially secured to an upper peripheral portion of said outer shell body section, said outer shell waist band being removably positioned under said waist band flap of said inner liner waist band, and said outer shell waist band being of a bright color that contrasts with the color of said outer shell body section for providing a readily observable indication of the absence of a complete assemblage of the multilayered protective trouser.

9. A multilayered protective trouser in accordance with claim 1 wherein said outer shell tab is of a bright color that contrasts with the color of said outer shell body section of said trouser outer shell for providing a readily observable indication, when said outer shell tab is not positioned between said first and second layers of said storm flap, of the absence of a complete assemblage of themultilayered protective trouser.

* * * * *